US005677270A

United States Patent [19]

Small, Jr. et al.

[11] Patent Number: 5,677,270

[45] Date of Patent: *Oct. 14, 1997

[54] METHODS FOR PREPARING NORMAL AND OVERBASED PHENATES

[75] Inventors: Vernon R. Small, Jr., Rodeo; William Woodford Willis, Jr., Pinole; John McDonald, Emeryville; Torrey A. Pennebaker, El Sobrante, all of Calif.; Jean Louis Le Coent, Le Havre, France

[73] Assignee: Chevron Chemical Company, San Ramon, Calif.

[ * ] Notice: The term of this patent shall not extend beyond the expiration date of Pat. No. 5,529,705.

[21] Appl. No.: 644,995

[22] Filed: May 14, 1996

Related U.S. Application Data

[63] Continuation-in-part of Ser. No. 406,336, Mar. 17, 1995, Pat. No. 5,529,705.

[51] Int. Cl.[6] ..... C10M 159/22

[52] U.S. Cl. ..... 508/574

[58] Field of Search ..... 508/574

[56] References Cited

U.S. PATENT DOCUMENTS

| | | | |
|---|---|---|---|
| Re. 26,811 | 3/1970 | Cohen | 508/574 |
| 3,178,368 | 4/1965 | Hanneman | 508/574 |
| 3,367,867 | 2/1968 | Abbott et al. | 508/574 |
| 3,810,837 | 5/1974 | Chafetz et al. | 508/574 |
| 3,923,670 | 12/1975 | Crawford | 508/574 |
| 4,608,184 | 8/1986 | Chang | 508/574 |
| 4,744,921 | 5/1988 | Liston | 508/574 |
| 5,529,705 | 6/1996 | Small, Jr. et al. | 508/574 |

FOREIGN PATENT DOCUMENTS

| | | | |
|---|---|---|---|
| 0 731 159 | 9/1996 | European Pat. Off. | C10M 159/20 |

*Primary Examiner*—Jacqueline V. Howard
*Attorney, Agent, or Firm*—Ernest A. Schaal

[57] ABSTRACT

Processes for preparing normal and overbased metal sulfurized alkylphenates. The processes am characterized by a sulfurization reaction using a lower carboxylic acid catalyst which does not use a polyol promoter, e.g., ethylene glycol. The process affords a metal sulfurized phenate product which is essentially free of polyol oxidation products. The products are useful as additives for lubricating oils.

25 Claims, No Drawings

METHODS FOR PREPARING NORMAL AND OVERBASED PHENATES

This application is a continuation-in-part of U.S. Ser. No. 08/406,336, filed Mar. 17, 1995, entitled "Methods for Preparing Normal and Overbased Phenates," now U.S. Pat. No. 5,529,705.

BACKGROUND OF THE INVENTION

This invention relates to processes and methods for preparing normal and overbased sulfurized alkylphenate compositions which are substantially free of the oxidation products of polyol promoters. In a further aspect, the invention relates to lubricating compositions and concentrates containing such compositions.

Group II metal overbased sulfurized alkylphenate compositions (sometimes referred to as "overbased phenates") are useful lubricating oil additives, which impart detergency and dispersancy properties to the lubricating oil composition, as well as providing for an alkalinity reserve in the oil. Alkalinity reserve is necessary in order to neutralize acids generated during engine operation. Without this alkalinity reserve, the acids so generated would result in harmful engine corrosion.

The preparation of overbased phenates is well known in the art and is described, for example, in U.S. Pat. Nos. 2,680,096; 3,178,368; 3,367,867; 3,801,507; and the like. The disclosures of each are incorporated herein by reference in their entirety. Typically, overbased phenates have been prepared by combining, under elevated temperatures, an alkylphenol, a neutral or overbased hydrocarbyl sulfonate, a high molecular weight alcohol, lubricating oil, a Group II metal oxide, hydroxide or $C_1$ to $C_6$ alkoxide, sulfur, and a polyol promoter, typically an alkylene glycol, to the heated mixture. The water of reaction is removed and carbon dioxide added. Uncombined $CO_2$ is removed and the reaction vessel is then further heated under vacuum to remove the alkylene glycol, water, and the high molecular weight alcohol. The product is overbased by incorporation therein of hydrated lime and carbon dioxide. Typically an alkylene glycol is used to promote both the neutralization and sulfurization, and also to facilitate overbasing.

However, a problem is encountered when the alkylene glycol or other polyol promoter is employed in the presence of significant amounts of sulfur. Specifically, under such reaction conditions, the alkylene glycol or other polyol promoter is oxidized (for example, ethylene glycol is oxidized to the calcium salt of oxalic acid) while the sulfur is reduced to hydrogen sulfide. Such oxidation products are known to be detrimental to engine life. For example, U.S. Pat. No. 4,608,184 discloses that calcium oxalate (an oxidation product of ethylene glycol) adversely effects engine performance as measured by the Caterpillar 1G2 test and suggests a sulfurized phenate synthesis which reduces the amount of calcium oxalate by adding the sulfur to a reaction product mix of a calcium base, alkylphenol, and glycol.

U.S. Pat. No. 4,744,921 discloses a method for preparing high TBN Group II metal overbased sulfurized alkylphenate compositions containing less than 10 mole percent unsulfurized alkylphenate, which has reduced sediments and exhibits better hydrolytic ability. Sulfurization is conducted using certain sulfurization catalysts without a polyol promoter. The sulfurized phenate is subsequently overbased using an alkylene glycol promoter. The patent does not consider unreacted sulfur or whether the overbasing reaction mixture, using glycol, contains elemental sulfur. The process suffers from the disadvantage that the preferred organic sulfurization catalysts are very expensive.

U.S. Pat. Nos. 3,437,595 and 3,923,670 disclose processes wherein sulfurization is conducted without a polyol promoter by using either a certain basic catalyst, in the case of U.S. Pat. No. 3,437,595, or an amount of an alkali metal hydroxide in excess of a catalytic amount, in the case of U.S. Pat. No. 3,923,670. Overbasing follows, using glycol and carbon dioxide. Neither patent considers unreacted sulfur and, in the case of the process described in U.S. Pat. No. 3,923,670 and the preferred process described in U.S. Pat. No. 3,437,595, the process suffers from the fact that the product contains undesirable alkali metal residues. The use of separation procedures to remove the alkali metal residues from the normal sulfurized phenate is economically undesirable and, in some instances, the separation procedure introduces problems which interfere with the overbasing process or produce an inferior overbased product.

In the typical preparation of overbased phenates using a polyol, typically ethylene glycol, the polyol is believed to function as a phase transfer agent and/or an activating agent for the alkaline earth metal base in the sulfurization, neutralization, and overbasing reactions. It is also known to the prior art that the neutralization can be catalyzed by certain low molecular weight carboxyl acids, such as formic and acetic acid or mixtures thereof, without the use of a polyol promoter. However, even where a low molecular weight carboxyl acid was used in the sulfurization reaction, a polyol promoter or a lower monohydric alcohol was also used. Thus, regardless of whatever process benefits were obtained by using a carboxylic acid catalyst, deleterious oxidation products were still produced if a polyol promoter was used. On the other hand, if a monohydric lower alcohol promoter were used in place of the polyol promoter, reaction rates necessarily suffered because lower reaction temperatures must be used because of the low boiling point of the alcohol promoter; particularly as the reaction is advantageously conducted at atmospheric pressure or under vacuum to reduce foaming.

U.S. Pat. No. 3,493,516 discloses a process for preparing sulfurized overbased alkaline earth metal alkyl phenates by combining a sulfurized alkyl phenol with lime at elevated temperatures according to known processes and incorporating into the composition a small amount of relatively low molecular weight carboxylic acid or mixtures thereof to form a calcium carboxylate. The patent teaches that the calcium salt of the low molecular weight carboxylic acid may be prepared in situ or prepared prior to introduction into the phenate composition or, alternatively, sulfur and alkyl phenol may be added to the reaction mixture in place of the sulfurized alkyl phenol. The patent teaches that the reaction mixture further contains a high molecular weight alcohol and a polyether alcohol of two to three carbon atoms, usually ethylene or propylene glycol. Illustrative low molecular weight carboxylic acids described in this patent include formic acid, acetic acid, glycolic acid, glyoxylic acid, propionic acid, maleic acid, etc. Examples 1 and 2 of this Patent describe a sulfurization-neutralization reaction between tetrapropenylphenol, lime, and sulfur, which is conducted in tridecyl alcohol and glycol in the presence of a mixture of formic acid and glycolic acid.

U.S. Pat. No. Re. 26,811 discloses a process for preparing basic sulfurized phenates and salicylates, which comprises reacting at a temperature above 150° C., (A) a phenol or an alkali metal or alkaline earth metal salt thereof, (B) sulfur, and (C) an alkaline earth base, in the presence of (D) a carboxylic acid or an alkali metal, alkaline earth metal, zinc or lead salt thereof, and (E) a compound of a formula $(ROR')_xOH$, wherein R is hydrogen or alkyl, R' is alkyl, and x is an integer which is at least two if R is hydrogen and at least one if R is alkyl. At column 3, lines 52–55, the patent teaches that the amount of carboxylic acid or salt to be used is generally about 5–20 mole percent, preferably about 5–10 mole percent, of the amount of phenol in the reaction mixture. Examples of cerboxylic acids and salts are set forth by the patent at column 3, lines 38–51, and include formic acid, acetic acid, propionic acid, acrylic acid, capric acid, stearic acid, maleic acid, etc., and salts, such as sodium acetate, lithium acetate, potassium stearic, calcium formate, calcium acetate, calcium salt of polyisobutene-substituted succinic acid, zinc acetate, lead propionate, and lead caprate. Aliphatic acids containing 2–6 carbon atoms and alkaline earth metals salts thereof, and especially acetic acid and the calcium acetate, are described as preferred. Thus, although a carboxylic acid is used, the sulfurization is still conducted in the presence of a polyol promoter; i.e. $(ROR')_xOH$.

U.S. Pat. No. 4,049,560 discloses a process for preparing an overbased magnesium sulfurized phenate which comprises introducing carbon dioxide into a reaction mixture comprising a. 15–40 wt % of a sulfurized phenol or thiophenol containing one or more hydrocarbyl substituents, or a phenol or thiophenol containing one or more hydrocarbyl substituents, or said phenol or thiophenol containing one or more hydrocarbyl substituents together with sulfur, b. 5–15 wt % of an organic sulfonic acid, an organic sulphonate, or an organic sulphate, c. 5–15 wt % of a glycol, a $C_1$ to $C_5$ monohydric alkanol, or $C_2$ to $C_6$ alkoxy alkanol, d. 2–15 wt % of a magnesium hydroxide or active magnesium oxide, e. at least 0.1 wt % of a $C_1$ to $C_{18}$ carboxylic acid, an anhydride thereof, or an ammonium, an amine salt, a Group I metal salt or a Group II metal salt of said $C_1$ to $C_{18}$ carboxylic acid, and f. at least 10% by weight of a diluent oil (including any present in components (a) and (b)).

The carboxylic acid is described as a promoter and is preferably used in an amount of 0.5 to 2.0% by weight and preferably is formic acid, acetic acid, propionic acid, or a butyric acid. But, the reaction mixture also contains a polyol promoter, i.e., a glycol or alkoxyalkanol, or contains a lower monohydric alkanol.

U.S. Pat. No. 5,035,816 discloses a process for preparing sulfurized overbased alkyl salicylates, which comprises neutralizing an alkyl phenol with an alkaline earth base in the presence of at least one acid selected from $C_1$ to $C_{18}$ aliphatic cerboxylic acid, benzoic acid, benzoic anhydride or mineral acids in the presence of an azeotropic solvent, followed by a carboxylation of the neutralized reaction product and sulfurization with sulfur in ethylene glycol. With respect to the neutralization step, the patent teaches that $C_1$ to $C_3$ aliphatic carboxylic acids, and especially their mixtures, for example the formic acid-acetic acid mixture according to an acetic/formic acid ratio which can range from 0.01/1 to 5/1, preferably from 0.25/1 to 2/1, and especially on the order of 1/1 are preferred. (See column 2, lines 53–58)

European Patent Application 271262, published Jun. 15, 1988, discloses a process for preparing sulfurized based hydrocarbyl phenates, which comprises reacting either a hydrocarbyl phenol or a hydrocarbyl phenol and sulfur with an alkaline earth metal base and at least one carboxylic acid having at least 12 carbon atoms in or with either a polyhydric alcohol or an alkyl glycol, alkyl glycol ether, or polyalkylene glycol alkyl ether. The patent further teaches that, when using a glycol or glycol ether, it is preferred to use in combination therewith an inorganic halide, for example ammonium chloride, and a lower, i.e., $C_1$ to $C_4$, carboxylic acid, for example acetic acid.

European Patent Application 0273588, published Jul. 6, 1988, discloses a process for increasing the TBN of an alkaline earth alkyl phenate which comprises reacting at elevated temperature a sulfurized alkaline earth metal hydrocarbyl phenate, an alkaline earth metal base, a carboxylic acid having at least 12 carbon atoms, and either a polyhydric alcohol having 2 to 4 carbon atoms, (di- or tri-) ($C_2$ to $C_4$) glycol, alkyl glycol, alkyl glycol ether, or a polyalkylene glycol alkyl ether.

SUMMARY OF THE INVENTION

The present invention is based, in part, on our discovery that sulfurized alkylphenates can be advantageously prepared without the use of a polyol or alkanol sulfurization promoter by conducting the sulfurization-neutralization in the presence of a lower molecular weight alkanoic acid, i.e., formic acid, acetic acid, or propionic acid, or a mixture of lower alkanoic acids. Because a polyol promoter is not used, the resulting normal or slightly overbased sulfurized phenate product is free of polyol oxalates or other deleterious byproducts of a polyol promoter. The reaction further provides for the effective consumption of virtually all of the elemental sulfur present in the reaction mixture. This is especially important where a high TBN overbased product is desired because the overbasing reaction generally requires a polyol promoter, e.g., alkylene glycol. Thus it is important to ensure that significant amounts of elemental sulfur are not present in the overbasing reaction mixture, which would promote the formation of glycol oxidation products.

Preferably, this process is conducted at temperatures in the range of about 130° C. to 300° C. In one embodiment, the sulfurization process is conducted in the presence of water throughout the process. Preferably, at least 50 wt % of the promoter is added to the reaction at a temperature of at least 130° C.

Both the normal and overbased sulfurized phenates produced by the present processes are useful as lubricating oil additives to provide acid neutralization capacity and improved detergency, and to a lesser extent antioxidancy, viscosity control and friction reduction and, based on preliminary testing, exhibit improved thermal stability. As well as reduced sediments, e.g., oxalates, the present process facilitates the use of higher sulfurization reaction temperatures, resulting in higher reaction rates. Accordingly, the present process provides increased process efficiency, reduced reactor resident time, and reduced capital equipment costs both in terms of reactor capacity and filtration costs.

Therefore, in one aspect, the invention provides an economical process for preparing normal and overbased sulfurized alkylphenate compositions that are free of polyol promoter oxidation products, which process comprises reacting an alkylphenol with sulfur in the presence of a lower carboxylic acid promoter and at least a stoichiometric amount of metal base, for example, calcium hydroxide, in the absence of a polyol promoter. Higher TBN products can be prepared by reacting the reaction product with carbon dioxide, in the presence of an alkylene glycol, preferably ethylene glycol, and preferably in the presence of a neutral or overbased sulfonate or an alkenyl succinimide. Additional metal base can be added in this step and/or excess metal base can be used in the neutralization step. Similarly, where a sulfonate or alkenyl succinimide is used, it may be added in the overbasing step or added to the sulfurization step and carried through to the overbasing step. As above noted, significant amounts of polyol oxidation products are not produced in the overbasing step because, if the sulfurization reaction has been properly conducted, all of the elemental sulfur will have been consumed and at most only trace amounts of elemental sulfur will be carried over to the overbasing reaction mixture. The presence of elemental sulfur is also deleterious in the final lubricating oil additive product because it promotes corrosion and staining of metal bearings, particularly copper bearings.

In further aspects, the process of the invention provides an additive concentrate, free of polyol oxidation byproducts, comprising a normal or moderately overbased sulfurized alkylphenate prepared by the above process and a minor amount of a compatible diluent, and a lubricating oil composition comprising a minor amount of the aforementioned normal or moderately overbased sulfurized alkylphenate concentrate and a major amount of an oil of lubricating viscosity.

In another aspect, the process of the invention provides an additive concentrate, substantially free of polyol promoter oxidation products, comprising a major amount of a high TBN overbased sulfurized alkylphenate, prepared by the above process wherein a stoichiometric excess of metal base is used and wherein following essentially complete consumption of the sulfur in the sulfurization step, the sulfurized phenate is treated with carbon dioxide in the presence of polyol promoter and additional metal base, if desired, and a minor amount of a compatible liquid diluent and a lubricating oil composition comprising a minor amount of said high TBN overbased sulfurized alkylphenate and a major amount of an oil of lubricating viscosity.

Very high TBN overbased sulfurized alkylphenate can be produced if the sulfurized phenate is treated with carbon dioxide in the presence of polyol promoter, additional metal base, and stearic acid. In this embodiment, the stearic acid acts only as a TBN booster, and not as a sulfurization promoter.

Further aspects of the invention will be apparent from the following description.

FURTHER DESCRIPTION OF THE INVENTION AND PREFERRED EMBODIMENTS

Prior to discussing the invention in further detail, the following terms will be defined:

Definitions

As used herein, the following terms have the following meanings, unless expressly stated to the contrary:

The term "Group II metal" or "alkaline earth metal" means calcium, barium, magnesium, and strontium.

The term "metal base" refers to a metal hydroxide, metal oxide, metal alkoxide and the like and mixtures thereof, wherein the metal is selected from the group consisting of lithium, sodium, potassium, magnesium, calcium, strontium, barium, or mixtures thereof.

The term "calcium base" refers to a calcium hydroxide, calcium oxide, calcium alkoxide, and the like, and mixtures thereof.

The term "lime" refers to calcium hydroxide, also known as slaked lime or hydrated lime.

The term "Total Base Number" or "TBN" refers to the amount of base equivalent to milligrams of KOH in 1 gram of sample. Thus, higher TBN numbers reflect more alkaline products, and therefore a greater alkalinity reserve. The TBN of a sample can be determined by ASTM Test No. D2896 or any other equivalent procedure.

The term "overbased sulfurized alkylphenate composition" refers to a composition comprising a small amount of diluent (e.g., lubricating oil) and a sulfurized alkylphenate complex wherein additional alkalinity is provided by a stoichiometric excess of a metal oxide, hydroxide or $C_1$ to $C_6$ alkoxide, based on the amount required to react with the hydroxide moiety of the sulfurized alkylphenol.

The term "normal sulfurized alkylphenate" refers to a sulfurized alkylphenate that contains a stoichiometric amount of metal base required to neutralize the hydroxy substituent. Such phenates are actually basic and typically exhibit a TBN of about 50 to 150 and are useful to neutralize engine acids.

The term "moderately overbased sulfurized alkylphenate" refers to an overbased sulfurized alkylphenate having a TBN of about 150 to 225.

The term "high TBN, overbased sulfurized alkylphenate compositions" refers to overbased sulfurized alkylphenate compositions having a TBN of about 225 to 350. Generally a carbon dioxide treatment is required to obtain high TBN overbased sulfurized alkylphenate compositions, resulting in what is believed to be a complex of the phenate with a colloidal dispersion of metal carbonate.

The term "lower alkanoic acid" refers to alkanoic acids having 1 through 3 carbon atoms, i.e., formic acid, acetic acid, and propionic acid, and mixtures thereof.

The term "oil solubility" means that the additive has a solubility of at least 50 grams per kilogram and preferably at least 100 grams per kilogram at 20° C. in a base 10W40 lubricating oil.

The term "alkylphenol" refers to a phenol group having one or more alkyl substituents at least one of which has a sufficient number of carbon atoms to impart oil solubility to the resulting phenate additive.

The term "polyol promoter" refers to a compound having two or more hydroxy substituents, generally the sorbitol type, for example, alkylene glycols and also derivatives thereof and functional equivalents such as polyol ethers and hydroxycarboxylic acids.

Synthesis

The present process can be conveniently conducted by contacting the desired alkylphenol with sulfur in the presence of a lower alkanoic acid and metal base under reactive conditions, preferably in an inert-compatible liquid hydrocarbon diluent. Preferably the reaction is conducted under an inert gas, typically nitrogen. In theory the neutralization can be conducted as a separate step prior to sulfurization, but pragmatically it is generally more convenient to conduct the sulfurization and the neutralization together in a single process step. Also, in place of the lower alkanoic acid, salts of the alkanoic acids or mixtures of the acids and salts could also be used. Where salts or mixtures of salts and acids are used, the salt is preferably an alkaline earth metal salt and most preferably a calcium salt. However, in general the acids are preferred and accordingly the process will be described below with respect to the use of lower alkanoic acid; however, it should be appreciated that the teachings are also applicable to the use of salts and mixtures of salts in place of all or a portion of the acids.

The combined neutralization and sulfurization reaction is typically conducted at temperatures in the range of about from 115° C. to 300° C., preferably 135° C. to 230° C., depending on the particular metal and alkanoic acid used. Where formic acid is used alone, we have found that best results are generally obtained by using temperatures in the range of about from 150° C. to 200° C. By using formic acid with other alkanoic acids (acetic, propionic, or acetic/propionic), one can advantageously use the higher reaction temperatures and obtain higher base retention and reduced piston deposits. For example, with these mixtures, one can use temperatures in the range of about from 180° C. to 250° C. and especially at temperatures of about from 200° C. to 235° C. Mixtures of two or all three of the lower alkanoic acids also can be used. Mixtures containing about from 5 to 25 wt % formic acid and about from 75 to 95 wt % acetic acid are especially advantageous where normal or moderately overbased products are desired. Based on one mole of alkylphenol, typically from 0.8 to 3.5, preferably from 1.2 to 2, moles of sulfur and about 0.025 to 2, preferably 0.1 to 0.8, moles of lower alkanoic acid are used. Typically about 0.3 to 1 mole, preferably 0.5 to 0.8 mole, of metal base are employed per mole of alkylphenol. In addition an amount of metal base sufficient to neutralize the lower alkanoic acid is also used. Thus overall, typically about from 0.3 to 2 moles of metal base are used per mole of alkylphenol, including the base required to neutralize the lower alkanoic acid. If preferred, lower alkanoic acid to alkylphenol and metal base to alkylphenol ratios are used, then the total metal base to alkylphenol ratio range will be about from 0.55 to 1.2 moles of metal base per mole of alkylphenol. Obviously, this additional metal base will not be required where salts of alkanoic acids are used in place of the acids. The reaction is also typically and preferably conducted in a compatible liquid diluent, preferably a low viscosity mineral or synthetic oil. The reaction is preferably conducted for a sufficient length of time to ensure complete reaction of the sulfur. This is especially important where high TBN products are desired because the synthesis of such products generally requires using carbon dioxide together with a polyol promoter. Accordingly, any unreacted sulfur remaining in the reaction mixture will catalyze the formation of deleterious oxidation products of the polyol promoter during the overbasing step.

Where the neutralization is conducted as a separate step, both the neutralization and the subsequent sulfurization are conducted under the same conditions as set forth above. Optionally specialized sulfurization catalysts, such as described in U.S. Pat. No. 4,744,921, the disclosure of which is hereby incorporated in its entirety, can be employed in the neutralization-sulfurization reaction together with the lower alkanoic acid. But, in general any benefit afforded by the sulfurization catalyst, for example, reduced reaction time, is offset by the increase in costs incurred by the catalyst and/or the presence of undesired residues in the case of halide catalysts or alkali metal sulfides; especially, as excellent reaction rates can be obtained by merely using acetic and/or propionic acid mixtures with formic acid and increasing reaction temperatures.

In one embodiment, the sulfurization process is conducted in the presence of water throughout the process. This results in lower crude sediments (more efficient filtration), less haze, and improved water stability.

Preferably, at least 50 wt % of the promoter is added to the reaction at a temperature of at least 130° C. This results in more efficient filtration.

If a high TBN product is desired, the sulfurized phenate product can be overbased by carbonation. Such carbonation can be conveniently effected by addition of a polyol promoter, typically an alkylene diol, e.g., ethylene glycol, and carbon dioxide to the sulfurized phenate reaction product. Additional metal base can be added at this time and/or excess metal base can be used in the neutralization step. Preferably, an alkenyl succinimide or a neutral or overbased Group II metal hydrocarbylsulfonate is added to either the neutralization-sulfurization reaction mixture or overbasing reaction mixture. The succinimide or sulfonate assists in solubilizing both the alkylphenol and the phenate reaction product and therefore, when used, is preferably added to the initial reaction mixture. Overbasing is typically conducted at temperatures in the range of above from 160° C. to 190° C., preferably 170° C. to 180° C., for about from 0.1 to 4 hours, depending on whether a moderate or high TBN product is desired. Conveniently, the reaction is conducted by the simple expedient of bubbling gaseous carbon dioxide through the reaction mixture. Excess diluent and any water formed during the overbasing reaction can be conveniently removed by distillation either during or after the reaction.

Carbon dioxide is employed in the reaction system in conjunction with the metal base to form overbased products and is typically employed at a ratio of about from 1 to 3 moles per mole of alkylphenol, and preferably from about 2 to about 3 moles per mole of alkylphenol. Preferably, the amount of $CO_2$ incorporated into the overbased sulfurized alkylphenate provides for a $CO_2$ to metal weight ratio of about from 0.65:1 to about 0.73:1. All of the metal base including the excess used for overbasing may be added in the neutralization or a portion of the Group II base can be added prior to carbonation.

Where a moderate TBN product (a TBN of about 150 to 225) is desired, a stoichiometric amount or slight excess of metal base can be used in the neutralization step; for example, about from 0.5 to 1.3 moles of base per mole of alkylphenol in addition to the amount needed to neutralize the lower alkanoic acid. High TBN products are typically prepared by using a mole ratio of metal base to alkylphenol of about 1 to 2.5, preferably about 1.5 to 2, a carbon dioxide mole ratio of about 0.2 to 2, preferably 0.4 to 1, moles of carbon dioxide per mole of alkylphenol and about 0.2 to 2, preferably 0.4 to 1.2, moles of alkylene glycol. Again where lower alkanoic acids are used, in contrast to their salts, an additional amount of metal base sufficient to neutralize the lower alkanoic acid should be used. As noted above all of the excess metal base needed to produce a high TBN product can be added in the neutralization-sulfurization step or the excess above that needed to neutralize the alkylphenol can be added in the overbasing step or divided in any proportion between the two steps. Typically where very high TBN products are desired a portion of the metal base will be added in the overbasing step. The neutralization reaction mixture or overbasing reaction mixture preferably also contains about from 1 to 20, preferably 5 to 15, weight percent of a neutral or overbased sulfonate and/or an alkenyl succinimide based on the weight of alkylphenol. (In general where high TBN are desired, TBN in the range of about from 250 to 300 are preferred.)

Typically, the process is conducted under vacuum up to a slight pressure, i.e., pressures ranging from about 25 mm Hg absolute to 850 mm Hg absolute and preferably is conducted under vacuum to reduce foaming up to atmospheric pressure, e.g., about from 40 mm Hg absolute to 760 mm Hg absolute.

Additional details regarding the general preparation of sulfurized phenates can be had by reference to the various publications and patents in this technology such as, for example, U.S. Pat. Nos. 2,680,096; 3,178,368 and 3,801,507. The relevant disclosures and these patents are hereby incorporated by reference in their entirety.

Considering now in detail, the reactants and reagents used in the present process, first all allotropic forms of sulfur can be used. The sulfur can be employed either as molten sulfur or as a solid (e.g., powder or particulate) or as a solid suspension in a compatible hydrocarbon liquid.

Preferably, the metal base used is calcium hydroxide because of its handling convenience versus, for example, calcium oxide, and also because it affords excellent results. Other calcium bases can also be used, for example, calcium alkoxides.

In one embodiment, a mixture of metal bases is used. For instance, a substantially calcium containing phenate is prepared with exactly enough lithium base to neutralize the alkanoic promoter.

In another embodiment, the metal base used is lithium hydroxide because it affords excellent results. Other lithium bases can also be used, for example, lithium alkoxides.

Suitable alkylphenols which can be used in this invention are those wherein the alkyl substituents contain a sufficient number of carbon atoms to render the resulting overbased sulfurized alkylphenate composition oil-soluble. Oil solubility may be provided by a single long chain alkyl substituent or by a combination of alkyl substituents. Typically the alkylphenol used in the present process will be a mixture of different alkylphenols, e.g., $C_1$–$C_{24}$ alkylphenol. Where phenate products having a TBN of 275 or less are desired, it is economically advantageous to use 100% polypropenyl substituted phenol because of its commercial availability and generally lower costs. Where higher TBN phenate products are desired, preferably about 25 to 100 mole percent of the alkylphenol will have straight-chain alkyl substituent of from 15 to 35 carbon atoms and from about 75 to 0 mole percent in which the alkyl group is polypropenyl of from 9 to 18 carbon atoms. More preferably, in about 35 to 100 mole percent of the alkylphenol the alkyl group will be a straight-chain alkyl of about 15 to 35 carbon atoms and in about from 65 to 0 mole percent of the alkylphenol, the alkyl group will be polypropenyl of from 9 to 18 carbon atoms. The use of an increasing amount of predominantly straight chain alkylphenols results in high TBN products generally characterized by lower viscosities. On the other hand, while polypropenylphenols are generally more economical than predominantly straight chain alkylphenols, the use of greater than 75 mole percent polypropenylphenol in the preparation of overbased sulfurized alkylphenate compositions generally results in products of undesirably high viscosities. However, use of a mixture of from 75 mole percent or less of polypropenylphenol of from 9 to 18 carbon atoms and from 25 mole percent or more of predominantly straight chain alkylphenol of from 15 to 35 carbon atoms allows for more economical products of acceptable viscosities.

Preferably, the alkylphenols are para-alkylphenols or ortho-alkylphenols. Since it is believed that para-alkylphenols facilitate the preparation of highly overbased sulfurized alkylphenate where overbased products are desired, the alkylphenol is preferably predominantly a para-alkylphenol with no more than about 45 mole percent of the alkylphenol being ortho-alkylphenols; and more preferably no more than about 35 mole percent of the alkylphenol is ortho-alkylphenol. Alkyl-hydroxy toluenes or xylenes, and other alkyl phenols having one or more alkyl substituents in addition to at least one long chained alkyl substituent can also be used.

In general the present process introduces no new factor or criteria for the selection of alkylphenols and accordingly the selection of alkylphenols can be based on the properties desired for lubricating oil compositions, notably TBN and oil solubility, and the criteria used in the prior art or similar sulfurization overbasing process and/or processes. For example, in the case of alkylphenate having substantially straight chain alkyl substituents, the viscosity of the alkylphenate composition can be influenced by the position of an attachment on alkyl chain to the phenyl ring, e.g., end attachment versus middle attachment. Additional information regarding this and the selection and preparation of suitable alkylphenols can be had for example from U.S. Pat. Nos. 5,024,773, 5,320,763; 5,318,710; and 5,320,762, all of which are hereby incorporated by reference in their entirety.

If a supplemental sulfurization catalyst, such as for example desired in U.S. Pat. No. 4,744,921, is employed, it is typically employed at from about 0.5 to 10 wt % relative to the alkylphenol, and preferably at from about 1 to 2 wt %. In a preferred embodiment, the sulfurization catalyst is added to the reaction mixture as a liquid. This can be accomplished by dissolving the sulfurization catalyst in molten sulfur or in the alkylphenol as a premix to the reaction.

The overbasing procedure used to prepare the high TBN overbased sulfurized alkylphenate compositions of this invention also employs a polyol promoter, typically a $C_2$ to $C_4$ alkylene glycol, preferably ethylene glycol, in the overbasing step.

Suitable Group II metal neutral or overbased hydrocarbyl sulfonates include natural or synthetic hydrocarbyl sulfonates such as petroleum sulfonate, synthetically alkylated aromatic sulfonates, or aliphatic sulfonates such as those derived from polyisobutylene. These sulfonates are well-known in the art. (Unlike phenates, "normal" sulfonates are neutral and hence are referred to as neutral sulfonates.) The hydrocarbyl group must have a sufficient number of carbon atoms to render the sulfonate molecule oil soluble. Preferably, the hydrocarbyl portion has at least 20 carbon atoms and may be aromatic or aliphatic, but is usually alkylaromatic. Most preferred for use are calcium, magnesium or barium sulfonates that are aromatic in character. Such sulfonates are conventionally used to facilitate the overbasing by keeping the calcium base in solutions.

Sulfonates suitable for use in the present process are typically prepared by sulfonating a petroleum fraction having aromatic groups, usually mono- or dialkylbenzene groups, and then forming the metal salt of the sulfonic acid material. The sulfonates can optionally be overbased to yield products having Total Base Numbers up to about 400 or more by addition of an excess of a Group II metal hydroxide or oxide and optionally carbon dioxide. Calcium hydroxide or oxide is the most commonly used material to produce the basic overbased sulfonates.

When employed, the Group II metal neutral or overbased hydrocarbyl sulfonate is employed at from about 1 to 20 wt % relative to the alkylphenol, preferably from about 1 to 10 wt %. Where the product is intended as an additive for marine crankcase lubricated oil formulations the use of Group II metal neutral or overbased hydrocarbyl sulfonate described above is especially attractive because sulfonates are advantageously employed in such formulations in conjunction with the overbased sulfurized alkylphenates.

Alternatively, in lieu of a Group II metal neutral or overbased hydrocarbyl or in combination therewith, an alkenyl succinimide may be employed. Alkenyl succinimides are well-known in the art. The alkenyl succinimides are the reaction product of a polyolefin polymer-substituted succinic anhydride with an amine, preferably a polyalkylene polyamine. The polyolefin polymer-substituted succinic anhydrides are obtained by reaction of a polyolefin polymer or a derivative thereof with maleic anhydride. The succinic anhydride thus obtained is reacted with the amine compound. The preparation of the alkenyl succinimides has been described many times in the art. See, for example, U.S. Pat. Nos. 3,390,082; 3,219,666; and 3,172,892, the disclosure of which are incorporated herein by reference. Alkyl succinimides are intended to be included within the scope of the term "alkenyl succinimide." The alkenyl group of the alkenyl succinic anhydride is derived from an alkene, preferably polyisobutene, and is obtained by polymerizing an alkene (e.g., isobutene) to provide for a polyalkene which can vary widely in its compositions. The average number of carbon atoms in the polyalkene and hence the alkenyl substituent of the succinic anhydride can range from 30 or less to 250 or more, with a resulting number average molecular weight of about 400 or less to 3,000 or more. Preferably, the average number of carbon atoms per polyalkene molecule will range from about 50 to about 100, with the polyalkenes having a number average molecular weight of about 600 to about 1,500. More preferably, the average number of carbon atoms in the polyalkene molecule ranges from about 60 to about 90, and the number average molecular weight ranges from about 800 to 1,300. Further information regarding the preparation of alkenyl succinimides and the succinic anhydride precursors can be had, for example, by reference to U.S. Pat. No. 4,744,921 and the references cited therein.

It is generally advantageous to use a small amount of an inert hydrocarbon diluent in the process to facilitate mixing and handling of the reaction mixture and product. Typically, a mineral oil will be used for this purpose because of its obvious compatibility with the use of the product in lubricating oil combinations. Suitable lubricating oil diluents which can be used include for example, solvent refined 100N, i.e., Cit-Con 100N, and hydrotreated 100N, i.e., RLOP 100N, and the like. The inert hydrocarbon diluent preferably has a viscosity of from about 1 to about 20 cSt at 100° C.

In the general preparation of overbased sulfurized alkylphenates, demulsifiers are frequently added to enhance the hydrolytic stability of the overbased sulfurized alkylphenate and may be similarly employed in the present process if desired. Suitable demulsifiers which can be used include, for example, nonionic detergents such as, for example, sold under the Trademark Triton X-45 and Triton X-100 by Rohm and Haas (Philadelphia, Pa.) and ethoxylated p-octylphenols. Other suitable commercially available demulsifiers include Igepal CO-610 available from GAF Corporation (New York, N.Y.). Where used, demulsifiers are generally added at from 0.1 to 1 wt % to the alkylphenol, preferably at from 0.1 to 0.5 wt %.

Lubricating Oil Compositions

The oil-soluble, overbased sulfurized alkylphenate compositions produced by the process of this invention are useful lubricating oil additives imparting detergency and dispersancy properties to the lubricating oil as well as providing an alkalinity reserve in the oil without adding polyol oxidation products. When employed in this manner, the amount of the oil-soluble, overbased sulfurized alkylphenate composition ranges from about 0.5 to 40 wt % of the total lubricant composition, although preferably from about 1 to 25 wt % of the total lubricant composition. Such lubricating oil compositions are useful in diesel engines, gasoline engines, as well as in marine engines. As noted above, when used in lubricating oil formulations for marine engines, such phenates are frequently used in combination with Group II metal overbased natural or synthetic hydrocarbyl sulfonates.

Such lubricating oil compositions employ a finished lubricating oil, which may be single or multigrade. Multigrade lubricating oils are prepared by adding viscosity index (VI) improvers. Typical viscosity index improvers are polyalkyl methacrylates, ethylene, propylene copolymers, styrene-diene copolymers, and the like. So-called dispersant VI improvers, which exhibit dispersant properties as well as VI modifying properties, can also be used in such formulations.

The lubricating oil, or base oil, used in such compositions may be mineral oil or synthetic oils of viscosity suitable for use in the crankcase of an internal combustion engine, such as gasoline engines and diesel engines, which include marine engines. Crankcase lubricating oils ordinarily have a viscosity of about 1300 cSt 0° F. to 24 cSt at 210° F. (99° C.). The lubricating oils may be derived from synthetic or natural sources. Mineral oil for use as the base oil in this invention includes paraffinic, naphthenic and other oils that are ordinarily used in lubricating oil compositions. Synthetic oils include both hydrocarbon synthetic oils and synthetic esters. Useful synthetic hydrocarbon oils include liquid polymers of alpha olefins having the proper viscosity. Especially useful are the hydrogenated liquid oligomers of $C_6$ to $C_{12}$ alpha olefins such as 1-decene trimer. Likewise, alkyl benzenes of proper viscosity, such as didodecyl benzene, can be used. Useful synthetic esters include the esters of both monocarboxylic acid and polycarboxylic acids, as well as monohydroxy alkanols and polyols. Typical examples are didodecyl adipate, pentaerythritol tetracaproate, di-2-ethylhexyl adipate, dilaurylsebacate and the like. Complex esters prepared from mixtures of mono and dicarboxylic acid and mono and dihydroxy alkanols can also be used.

Blends of hydrocarbon oils with synthetic oils are also useful. For example, blends of 10 to 25 wt % hydrogenated 1-decane trimer with 75 to 90 wt % 150 SUS (100° F.) mineral oil gives an excellent lubricating oil base.

Other additives which may be present in the formulation include rust inhibitors, foam inhibitors, corrosion inhibitors, metal deactivators, pour point depressants, antioxidants, and a variety of other well-known additives.

A further understanding of the invention can be had from the following non-limiting examples.

EXAMPLES

The invention will be further illustrated by the following examples, which set forth particularly advantageous method embodiments. While the Examples are provided to illustrate the present invention, they are not intended to limit it.

Example 1

250 TBN Overbased Calcium Sulfurized Alkylphenate

This example illustrates a procedure according to the invention for preparing the title composition using a formic acid/acetic acid catalyzed sulfurization reaction.

Reaction

In this example a reaction vessel with overhead stirrer and nitrogen flow was charged with 1,220 grams of propylene tetramer alkylphenol, 600 grams of a 100 neutral diluent oil, 41.5 grams of 10% formic/90% acetic, which was diluted with water to prevent freezing during winter storage, 200 grams sulfur powder, and 578 grams of calcium hydroxide. The mixture was heated with stirring from 60° C. to 200° C. over three hours while water distillate was being returned at a rate of two grams per minute. The reaction was held at this temperature for two hours while water return was continued. Water return was stopped and 300 grams of 100 neutral diluent oil was added over one minute followed by 275 grams of ethylene glycol added over 20 minutes. The temperature was adjusted to 174° C., and 173 grams of carbon dioxide was sparged through the mixture over three hours with rapid stirring. The water was distilled off by the following procedure.

Distillation

The temperature was raised to 240° C. over 45 minutes and 6 psia, where it was held for 30 minutes. The concentrate was filtered over diatomaceous earth and diluted to 250 TBN with diluent oil. About 3,200 grams of the product was collected.

Example 2

250 TBN Overbased Calcium-Lithium Sulfurized Alkylphenate

The above example is followed exactly, with the exception that only 540 grams of calcium hydroxide are used, and 42 grams of lithium hydroxide monohydrate are added.

Example 3

250 TBN Overbased Calcium Sulfurized Alkylphenate

This example illustrates a procedure, according to the invention, for preparing the title composition using a formic acid catalyzed sulfurization reaction.

Reaction

In this example a reaction vessel with overhead stirrer and nitrogen flow is charged with 1,220 grams of propylene tetramer alkylphenol, 400 grams of a 100 neutral diluent oil, 21 grams formic acid, 200 grams sulfur powder, and 198 grams of calcium hydroxide. The mixture is heated with stirring from room temperature to 170° C. over 3.5 hours and then held at 170° C. for another two hours. A portion of the water produced by the neutralization is continuously distilled off during the reaction. Then a slurry of 380 grams of calcium hydroxide and 122 grams of a neutral sulfonate in 600 grams diluent oil is then added over about one minute. The temperature is adjusted to 175° C., and 277 grams of ethylene glycol is added over 20 minutes. 173 grams of carbon dioxide is bubbled through the mixture over two hours with rapid stirring. The water can be distilled off by the following procedure:

Distillation

The temperature is raised from 175° C. to 240° C. over 45 minutes at 8 psia, where it is held 30 minutes. The distillate is collected. The concentrate is filtered over diatomaceous earth and diluted to 250 TBN with diluent oil.

Example 4

125 TBN Calcium Sulfurized Alkylphenate

This example illustrates a procedure according to the invention for preparing the title composition using a sulfurization reaction catalyst by a mixture of acetic acid, formic acid, and water. A two liter vessel with overhead stirrer and nitrogen flow was charged with 1,391 grams of propylene tetramer alkylphenol, 842 grams 100 neutral diluent oil, 219 grams calcium hydroxide, 236 grams sulfur, and 90 grams of a catalyst mixture composed of 27 grams water plus 63 grams of 10% formic/90% acetic acid. The reaction mixture was heated to 250° C. over five hours while water of distillation was returned via peristaltic pump to the reaction mixture at a rate of two grams/minute. The temperature was held at 250° C. for one hour, then allowed to cool to 205° C., all the while continuing to operate the peristaltic pump. At this point the pump was turned off and the mixture was distilled under vacuum at 1 psia for 0.5 hour. The concentrate was cooled to 180° C., filtered over diatomaceous earth, and diluted to 125 TBN with diluent oil.

Example 5

125 TBN Calcium Sulfurized Alkylphenate with Split Formic/Acetic

This example illustrates the procedure for holding off addition of the majority of promoter until 163° C., for the purpose of improving filtration. A reaction vessel with overhead stirrer and nitrogen flow was charged with 1,391 grams of propylene tetramer alkylphenol, 842 grams of a 100 neutral diluent oil, 219 grams calcium hydroxide, and 11 grams of promoter comprised of 90% glacial acetic, and 10% technical grade formic acid. Next, 256 grams solid sulfur was added. The mixture was heated from room temperature to 163° C. in 90 minutes and held there for one hour. During this one hour hold, 33 grams of promoter was added over 30 minutes. A portion of the water produced by the neutralization was continuously distilled off during the reaction. Finally, the reaction was ramped to 205° C. over 95 minutes, and the mixture was held at this temperature for three hours. The vessel was adjusted to 0.5 psia over ten minutes, and held under these conditions for 30 minutes, whereupon a small amount of yellow oily substance was removed. Vacuum was broken with nitrogen, the concentrate was cooled to 180° C., filtered over diatomaceous earth and diluted to 125 TBN with diluent oil.

Results of Gelman Filtration:

Procedure: All crude products were admixed with diatomaceous earth and then filtered over a cake of diatomaceous earth in a Gelman apparatus. Temperature=177° C., 80 psia filtration pressure for one hour. The following table compares total grams filtered for (1) the split F/A vs (2) total gram filtered for all F/A added in premix:

| Split F/A | Not Split F/A |
|---|---|
| 651 | 147 |
| 352 | 100 |
| 385 | 52 |
| 407 | |

Example 6

125 TBN Calcium-Potassium Sulfurized Alkylphenate

This example illustrates a procedure according to the invention of preparing the title composition using a mixture of potassium hydroxide and calcium hydroxide. A two liter vessel with overhead stirrer and nitrogen flow was charged with 1,391 grams of propylene tetramer alkylphenol, 842 grams 100 neutral diluent oil, 139 grams calcium hydroxide, 121 grams of potassium hydroxide pellets (85% pure), 236 grams sulfur, and 90 grams of a catalyst mixture composed of 27 grams water plus 63 grams of 10% formic/90% acetic acid. The reaction mixture was heated to 250° C. over five hours while water of distillation was returned via peristaltic pump to the reaction mixture at a rate of two grams/minute. The temperature was held at 250° C. for one hour, then allowed to cool to 205° C., all the while continuing to operate the peristaltic pump. At this point the pump was turned off and the mixture was distilled under vacuum at one psia for 0.5 hour. The concentrate was cooled to 180° C., filtered over diatomaceous earth, and diluted to 125 TBN with diluent oil.

Example 7

Stearic Acid-Formic/Acetic

400 TBN Phenate with Water Return

This example illustrates a procedure according to the invention of preparing the title composition using stearic acid. A 5 liter vessel with overhead stirrer is charged with 1,220 grams of propylene tetramer, 980 grams 100 neutral diluent oil, 1,400 grams lime, 203 grams sulfur, 782 grams stearic acid, and 41.5 grams of 10% formic/90% acetic, which is diluted with water. The vessel is quickly flushed with nitrogen, then heated to 205° C. over three hours, and is held at that temperature for three additional hours. During all this time, water of reflux is added back at the rate of two grams per minute.

Next, 500 grams of ethylene glycol is added over 30 minutes. The temperature is adjusted to 174° C., and carbonation is continued for three hours with rapid stirring. In all, 590 grams of carbon dioxide is delivered to the reactor. The water generated is distilled off.

At the completion of carbonation, the temperature is raised to 240° C. over 45 minutes at 6 psia, where it is held for 30 minutes. The distillate is collected. The concentrate is filtered over diatomaceous earth and diluted to 400 TBN.

Example 8

Determination of Oxalate Concentration

The formic/acetic promoted sulfurization of this invention affords a product with substantially less oxalate than in currently available highly overbased products, which depend on ethylene glycol promotion of the sulfurization step. The oxalate concentrations of metal overbased sulfurized alkylphenate products can determined by the procedure described below.

Oxalate presence in the overbased phenate composition is determined by the presence of an infrared peak at 1660 $cm^{-1}$ and the concentration of the oxalate is determined by peak intensity by first diluting the overbased phenate with diluent oil until a 50 TBN product is achieved. A small amount of the resulting composition is then placed in a 0.2 millimeter (nominal thickness) infrared cavity cell (e.g., sodium chloride plate). A 0.2 millimeter (nominal thickness) sodium chloride reference cavity cell containing only diluent oil is also prepared.

The cells are scanned on a Perkin Elmer Model 281 Infrared Spectrophotometer using the two sodium chloride cells, slit N and scan speed 12 minutes. The infrared spectra from 2000 to 1500 $cm^{-1}$ is determined for the sample. The X axis of the IR spectra measures $cm^{-1}$ and the Y axis measures absorbance in absorbance units. The peak at 1660 $cm^{-1}$ is due to oxalate formation. The actual determination or calculation of oxalate absorbent number is made by a machine which subtracts the oxalate spectrum from the reference spectrum and then scales the net absorbance to a standard 0.2000 mm cell using the appropriate cell path length inputted into the machine.

While the present invention has been described with reference to specific embodiments, this application is intended to cover those various changes and substitutions that may be made by those skilled in the art without departing from the spirit and scope of the appended claims.

What is claimed is:

1. A process for preparing a metal sulfurized alkylphenate composition having a TBN of about from 50 to 150 which is substantially free of polyol promoter oxidation products which comprises contacting an alkylphenol, having at least one alkyl substituent having from 6 to 36 carbon atoms, with sulfur, in the presence of a promoter selected from the group of alkanoic acids having 1 through 3 carbon atoms, and mixtures of said alkanoic acids, metal salts of alkanoic acids, and mixtures thereof, and at least a stoichiometric amount of a metal base sufficient to neutralize said alkylphenol and said carboxylic acid under reactive conditions, in the absence of a polyol promoter or an alcohol for a sufficient period of time to react essentially all of the sulfur thereby yielding a metal sulfurized alkylphenate reaction product mixture essentially free of elemental sulfur, wherein the metal is selected from the group consisting of metal hydroxide, metal oxide, metal alkoxide and mixtures thereof, and wherein the metal is selected from the group consisting of lithium, sodium, potassium, magnesium, calcium, strontium, barium, or mixtures thereof.

2. The process according to claim 1 wherein said process is conducted at temperatures in the range of about 130° C. to 300° C.

3. The process according to claim 1 wherein said process is conducted in the presence of water throughout said process.

4. The process according to claim 1 wherein at least 50 wt % of the promoter is added to the reaction at a temperature of at least 130° C.

5. The process according to claim 1 wherein said process is conducted using about from 0.8 to 3.5 moles of said sulfur, 0.025 to 2 moles of said promoter, 0.4 to 1.2 moles of said metal base per mole of said alkylphenol, an additional neutralizing amount of metal base per mole of said carboxylic acid, and a minor amount of an inert organic liquid diluent.

6. The process according to claim 5 wherein said process is conducted at pressures in the range of about from 25 mm Hg absolute to 850 mm Hg absolute.

7. The process according to claim 5 wherein said promoter is a carboxylic acid and is selected from the group of acetic acid, propionic acid, mixtures of acetic and propionic acid, and mixtures thereof with formic acid.

8. The process according to claim 7 wherein said process is conducted at temperatures in the range of about from 170° C. to 300° C.

9. The process according to claim 7 wherein said promoter is selected from the group of acetic acid, propionic acid and mixtures thereof and said process is conducted at temperatures in the range of about from 190° C. to 300° C.

10. The process according to claim 7 wherein said carboxylic acid is a mixture of formic acid and acetic acid and said process is conducted at temperatures in the range of about from 130° C. to 300° C.

11. The process according to claim 10 wherein said carboxylic acid is a mixture containing about from 5 to 25 wt % formic acid and about from 75 to 95 wt % acetic acid.

12. The process according to claim 5 wherein said promoter is formic acid and said process is conducted at temperatures of about from 130° C. to 175° C.

13. The process according to claim 1, wherein said promoter is selected from the group of calcium formate, calcium acetate, calcium propionate and mixtures thereof.

14. A process for preparing a metal overbased sulfurized alkylphenate composition having a TBN of at least 200 which is substantially free of polyol promoter oxidation products, which comprises the steps of:

(a) contacting an alkylphenol, having at least one alkyl substituent having from 6 to 36 carbon atoms, with sulfur, in the presence of a promoter acid selected from the group of alkanoic acids having 1 through 3 carbon atoms, mixtures of said alkanoic acids, metal salts of said alkanoic acids, and mixtures thereof, and at least a stoichiometric amount of a metal base sufficient to neutralize said alkylphenol and said promoter under reactive conditions in the absence of a polyol promoter or an alcohol for a sufficient period of time to react essentially all of said sulfur thereby yielding a metal sulfurized alkylphenate essentially free of elemental sulfur, wherein the metal base is selected from the group consisting of metal hydroxide, metal oxide, metal alkoxide and mixtures thereof, and wherein the metal is selected from the group consisting of lithium, sodium, potassium, magnesium, calcium, strontium, barium, or mixtures thereof; and (b) contacting the reaction product of step (a) with carbon dioxide and additional metal base, if required to provide the desired TBN, in the presence of an alkylene glycol having 2 to 6 carbon atoms under reactive conditions at temperatures in the range of about from 160° C. to 190° C.

15. The process according to claim 14 wherein step (a) of said process is conducted at temperatures in the range of about 130° C. to 300° C.

16. The process according to claim 14 wherein step (a) of said process is conducted in the presence of water throughout step (a).

17. The process according to claim 15 wherein step (a) is conducted using about from 0.8 to 3.5 moles of said sulfur, 0.025 to 2 moles of said promoter, 0.5 to 2.5 moles of said metal per mole of said alkylphenol, an additional neutralizing amount of said metal base per mole of said alkanoic acid, and a minor amount of an inert organic liquid diluent.

18. The process according to claim 17 wherein step (b) is conducted in situ with the reaction product mixture of step (a) and wherein said step (b) is conducted using about from 1 to 2 moles of said metal base, about 0.2 to 2 moles of carbon dioxide, and 0.2 to 2 moles of said alkylene glycol per moles of said alkylphenol, wherein said alkylene glycol is ethylene glycol.

19. The process according to claim 18 wherein said steps (a) and (b) are conducted at pressures in the range of about from 25 mm Hg absolute to 850 mm Hg absolute.

20. The process according to claim 18 wherein said promoter is selected from the group of formic acid, acetic acid, and mixtures thereof.

21. The process according to claim 20 wherein said promoter is formic acid and step (a) is conducted at temperatures of about from 130° C. to 175° C.

22. The process according to claim 20 wherein said promoter is selected from acetic acid, propionic acid, mixtures of acetic acid and propionic acid, and mixtures thereof with formic acid, and wherein step (a) is conducted at temperatures in the range of about from 170° C. to 300° C.

23. The process according to claim 22 wherein said promoter is selected from the group of acetic acid, propionic acid, and mixtures thereto, and wherein step (a) is conducted at temperatures in the range of about from 190° C. to 300° C.

24. The process according to claim 14, wherein said promoter is selected from the group of calcium formate, calcium acetate, calcium propionate and mixtures thereof.

25. The process according to claim 14, wherein step (a) occurs in the presence of stearic acid.

* * * * *